United States Patent [19]

Hidaka

[11] Patent Number: 4,778,171

[45] Date of Patent: Oct. 18, 1988

[54] TRAY ASSEMBLY FOR SORTING MACHINE

[75] Inventor: Masanori Hidaka, Mito, Japan

[73] Assignee: Ikegami Tsushinki Co., Ltd., Tokyo, Japan

[21] Appl. No.: 20,488

[22] Filed: Mar. 2, 1987

[51] Int. Cl.[4] ..... B65H 39/11

[52] U.S. Cl. ..... 271/293; 271/294; 271/296

[58] Field of Search ..... 271/292–294, 271/287, 296

[56] References Cited

U.S. PATENT DOCUMENTS

| | | | |
|---|---|---|---|
| 3,096,089 | 7/1963 | Swenker et al. | 271/293 |
| 3,788,640 | 1/1974 | Stemmle | 271/294 |
| 4,332,377 | 6/1982 | DuBois et al. | 271/294 |
| 4,580,775 | 4/1986 | Matuyama | 271/294 |

FOREIGN PATENT DOCUMENTS

| | | | |
|---|---|---|---|
| 58-22259 | 2/1983 | Japan | 271/287 |
| 58-212556 | 12/1983 | Japan | 271/293 |
| 60-232369 | 11/1985 | Japan | 271/293 |

*Primary Examiner*—H. Grant Skaggs

*Attorney, Agent, or Firm*—Parkhurst, Oliff & Berridge

[57] ABSTRACT

A tray assembly for a sorting machine having a pair of tray pins disposed on both edges of a sheet entry side tray, a supporting member disposed at each tray end of a plurality of trays for forming a gap between each two trays of the plurality of trays in a stacked condition, and a hook for increasing the gap between tray ends in response to a movement of one of the trays while a tray entry forming member forms a tray entry successively each time that a sheet is fed to the tray assembly. A compact tray assembly can accommodate increased storage volume of sheets with reduced noise and jamming.

10 Claims, 4 Drawing Sheets

TRAY ASSEMBLY FOR SORTING MACHINE

BACKGROUND OF THE INVENTION

1. FIELD OF THE INVENTION

The present invention relates to a tray assembly for sorting machine, and more particularly to a tray assembly for sorting machine that is used as a tray for sorting when automatically sorting and storing recorded sheets, and which has entry forming means forming successively tray entry portions between trays supported in a stacked condition.

2. DESCRIPTION OF THE PRIOR ART

In a conventional sorting machine, a pair of cylindrical tray entry forming members was disposed on a tray entry side of stacked trays so as to permit formation of tray entry portions successively when recorded sheets were transported. These tray entry forming members were able to move freely either upwardly or downwardly, and could rotate freely around a vertical axis. This rotating motion moved a tray pin supported above or below the tray entry forming member upwardly or downwardly.

FIG. 1 is a side view showing an example of this type of sorting machine and tray. In FIG. 1, reference numeral 1 denotes a sheet feeding portion, and reference numerals 1A and 1B denote an upper and a lower guide plate formed on the sheet feeding portion 1. Reference numeral 2 denotes a recorded sheet sent from a printing apparatus or a copier not shown. This recorded sheet 2 is fed between the guide plates 1A and 1B.

Reference numeral 3 denotes a sheet feed roller driven by a motor 4, and reference numeral 5 denotes a guide roller for feeding the sheet by contacting the sheet feed roller 3. Reference numeral 6 denotes a discharge roller coupled to the sheet feed roller 3 through a belt 7, and reference numeral 8 denotes a guide roller for discharging a sheet 2 by contacting the discharge roller 6. The axis of the discharge roller 6 and the guide roller 8 are supported by a frame 9. This support frame 9 is disposed so it can slide freely along a guide post 10. Reference numerals 11A and 11B denote upper and lower guide plates disposed respectively between the guide roller 5 and the guide roller 8, and between the sheet feed roller 3 and the discharge roller 6. The guide plates 11A and 11B form the sheet transport route 11.

Furthermore, reference numeral 12 denotes a tray entry forming member having a cylindrical form. Reference numeral 13 denotes a rotating axis of the tray entry forming member 12. The top and bottom surfaces of the tray entry forming member 12 are sandwiched slidably by the frame 9. As described below, when the tray entry forming member 12 moves upwardly or downwardly, the discharge roller 6 and the guide roller 8 are moved in combination simultaneously upwardly or downwardly by the frame 9.

In this arrangement, the tray entry forming member 12 is coupled to the rotating axis 13 so as to be slidable only upwardly and downwardly. Moreover, the rail portion not shown on the rotating axis 13 engages in the groove (not shown) along the length of the tray entry forming member 12 so that the tray entry forming member 12 rotates integrally with the rotating axis 13 only when the rotating axis 13 rotates, and is supported while rotating by the rotating axis 13 so as to be slidable upwardly and downwardly.

The reference numeral 12B denotes a spiral groove worked into the outer circumferential surface of the tray entry forming member 12. The top end and bottom end of the spiral groove 12B are formed into a cuneiform shape. Furthermore, the groove 12B is formed to provide one pitch height in the present example between the top surface and the lower surface of the supporting member This spiral groove 12B makes it possible to move a pin 14A on the edge portion on the entry side of the tray 14 upwardly and downwardly.

Moreover, reference numeral 15 denotes a tray rest supporting the trays 14 at a predetermined inclination. The trays 14 are spaced at predetermined intervals by a supporting member 14C disposed at a tray edge 14B and by a pin 14A. The trays 14 are stacked on top of the tray rest 15. Reference numeral 18 denotes a motor that can rotate the rotating axis 13 in one direction and in an opposite direction.

In the arrangement of a sorting machine such as this, when, for example, the tray entry forming member 12 is lowered from its present position so that a tray entry portion 17 is formed at successively lower levels, if first a motor 18 rotates the rotating axis 13 in a clockwise direction as viewed from above, the pin 14A on the tray 14 that is contacting the lower surface of the tray entry forming member 12 will be guided into the spiral groove 12B, and as the rotation continues the pin 14A will be forced upwards. Thereby, when the rotating axis 13 has rotated once this pin 14A will be supported on the upper surface of the tray entry forming member 12, and at the same time, the tray entry forming member 12 will drop along the rotating axis 13 by a distance corresponding to the diameter of the pin 14A. The lower surface of that tray entry forming member 12 will be supported in contact with the pin 14A immediately below, and the tray entry portion 17 will be formed at a position one level lower.

Furthermore, rotation of the rotating axis 13 in an opposite counterclockwise direction will cause the tray pin 14A that is contacting and supported by the upper surface of the tray entry forming member 12 to be guided into the spiral groove 12B, thereby making it possible to lower that tray 14 by one level and to form a tray entry portion 17 in a position one level higher.

The supporting member 14C that supports the trays 14 when said trays are stacked is disposed near the left and right sides of the tray edge 14B. When the tray 14 is moved upwardly and downwardly by the tray entry forming member 12, the supporting members 14C push out or retract like arrows as they slide against one another in response to that movement of the tray 14. The height between the stacked trays at the tray edges 14B in the stacked condition is determined by the height of a protrusion 14D formed on the upper surface of the supporting member 14C.

This stacked height is determined in accordance with the estimated maximum thickness of recorded sheets that will be loaded into the individual trays 14. In recent years, as the demand has risen for comparatively greater volumes of sheets to be stored in the tray 14, the conventional shape and construction of the supporting member 14C have resulted in many problems.

In particular, with the increasing speed of recording processing the noise of the shock generated when supporting members 14C push out or retract together, when only a small volume of sheets is stored, has increased in loudness to the extent that it has become necessary to suppress such noise to allow for the use of such Office Automation equipments inside offices.

Another problem has been the propensity for sheets to jam due to the tapering of the interval between the tray edges with respect to the interval at the tray entry portion.

SUMMARY OF THE INVENTION

It is, therefore, an object of the present invention to provide a tray assembly for a low-noise sorting machine in which a wider interval between trays at their edges is obtained by supporting members at the tray edges moving smoothly in response to an action of the trays when the trays are moved upwardly or downwardly by a tray entry forming member.

It is another object of the present invention to provide a tray assembly for a sorting machine which can increase a sorting volume of the tray by increasing a size of an interval between trays at a tray edge as an interval between trays at a tray entry portion.

It is another object of the present invention to provide a tray assembly for a sorting machine which can reduce power consumption of a motor driving the tray entry forming member by utilizing the principle of a lever.

It is a still further object of the present invention to provide a tray assembly for a sorting machine which will minimize jamming and even should such jamming occur, facilitates clearing of said jamming.

In order to achieve these objects, in an aspect of the present invention a sorting machine has a pair of tray pins disposed on both sides of a sheet entry portion and a supporting member disposed so as to enable both sides of a front edge to be supported in a stacked condition, thereby forming a sheet entry portion, and is arranged so said tray pins are supported above and below a tray entry forming member that is rotatable and movable upwardly and downwardly so that when one of the tray pins is moved upwardly or downwardly by driving of a tray entry forming member, the sheet entry portion formed between the tray pins is moved. On trays of this sorting machine an engaging groove is disposed on an upper surface of each supporting member, and a supporting lever is disposed on the lower surface of the supporting member so that its front edge can engage in the engaging groove of the supporting member that contacts the lower surface of an above supporting member when said trays are stacked. This supporting lever is fitted rotatably into a hole in the supporting member so that when the tray is moved by the tray entry forming member through the tray pin, the supporting lever disposed on the supporting member of the tray is rotated in response to the movement of the tray and the interval between the supporting member of the tray that is moved by the rotation of the supporting lever and the other supporting member is maintained.

The above and other objects, effects, features and advantages of the present invention will become more apparent from the following description of preferred embodiments thereof taken in conjunction with the accompanying drawings.

DETAILED DESCRIPTION OF PREFERRED EMBODIMENTS

Figure 2:
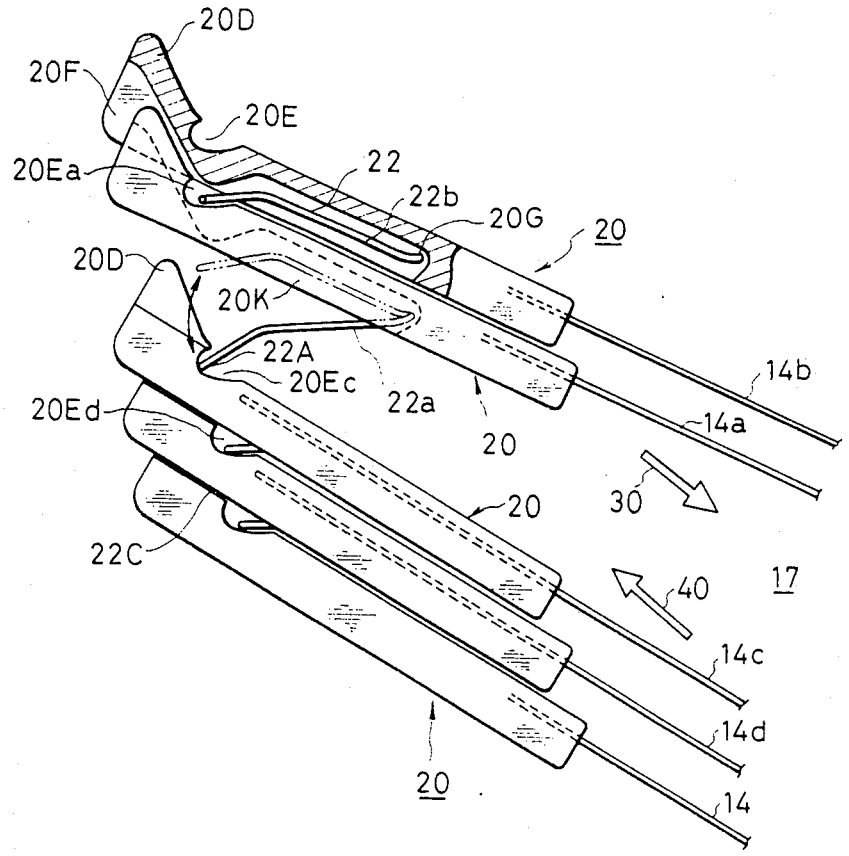
FIG. 2 is a side view, partially exploded, showing an arrangement in the vicinity of a front edge of a tray including a tray supporting member in a first embodiment of a sorting machine according to the present invention.
Figure 3A:
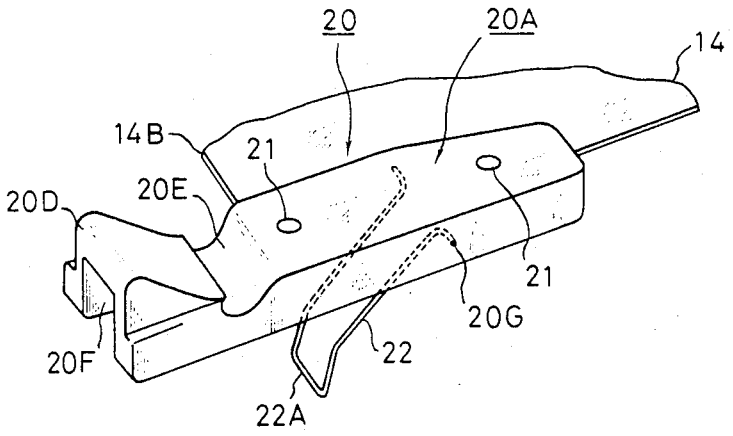
FIGS. 3A and 3B are perspective views from above and below respectively showing a tray supporting member shown in FIG. 2.
Figure 3B:
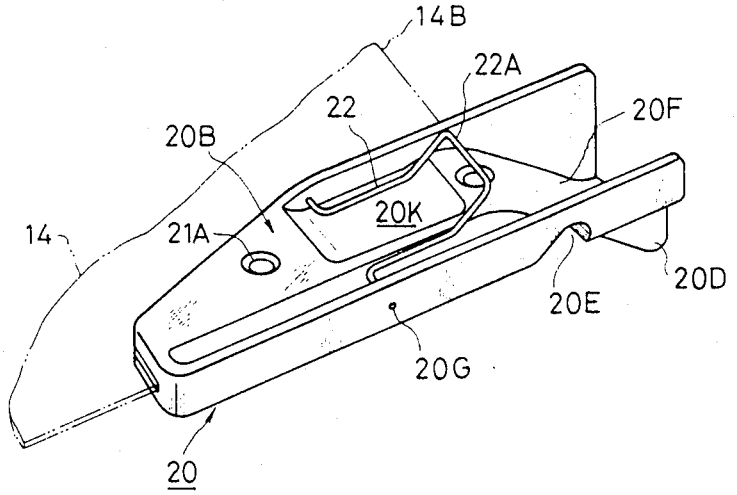

FIG. 2 shows a part of an embodiment of the present invention. In FIG. 2, because an arrangement of a tray entry portion and a tray entry forming member is the same as in the previously described conventional apparatus, an explanation of the conventional apparatus corresponding to those will be incorporated as an explanation of the present embodiment. In FIG. 2, reference numeral 20 denotes a supporting member of trays 14 in a stacked condition above and below a tray entry portion 17. As shown in FIG. 3A, a supporting member 20 is fixed by a rivet in an ear portion at both sides of a tray front.

The supporting member 20 can be made of any material such as plastic as long as its surface has good slidability, it can be easily worked and it is light in weight. In the present embodiment, a protrusion 20D and an engaging groove 20E are formed on the upper surface 20A of the supporting member 20.

As shown in FIG. 3A, a smooth inclined groove 20F is formed on the lower surface 20B of the supporting member 20 in a shape corresponding to the protrusion 20D.

Furthermore, on a side of the lower surface 20B is fitted in a hole 20G rotatably and rested in a recess or a lever housing portion 20K a hook lever 22 made from a resilient material and having a U shape. The front portion 22A of the hook lever 22 is bent into a hook shape, so that when the suporting members stack on to one another, this hook lever 22 rests in the recess 20K and the hook-shaped front portion 22A engages with the engaging groove 20E of the tray below as shown in FIG. 2. Reference numeral 21A denotes a rivet hole.

The cross-sectional shape of the engaging groove 20E is matched to the hook lever front portion 22A when the supporting members 20 are stacked. The front portion 22A is formed to limit its movement toward the protrusion 20D from the engaging groove 20E in which it is engaged, and is supported in its engaged condition in the engaging groove 20E so as to function as a pivot for rotation of the hook lever 22.

Next, an explanation will be made of an action at the supporting member 20 disposed on a tray front edge 14B when a tray entry portion 17 on a tray in a sorting machine arranged in this manner is moved. In the condition when a tray entry portion 17 is formed as shown in FIG. 2, as explained in a conventional apparatus with reference to FIG. 1 when a rotation of a tray entry forming member 12 causes, for example, the tray **14*a* positioned above the tray entry portion 17 to move beneath the tray entry portion 17 so that the tray entry portion 17 is formed with respect to the tray 14*a* which has dropped, this tray 14*a* moves as indicated by an arrow 30 due to the rotation of the tray entry forming member 12**.

Then, the hook lever **22*a* of the upper tray 14*a* which was engaged to the supporting member engaging groove 20E*c* of the tray 14*c* which was until this time beneath the tray entry portion 17 rotates around this engaging position as a pivot while its front portion 22A is still engaged in the engaging groove 20E***c*, and folds into its lever housing portion 20K.

On the other hand, the movement in the direction of the arrow 30 of the tray 14*a* that drops at the same time causes the hook lever 22*b* to rotate counterclockwise around the hole 20G as center while the hook lever front portion 22A of the tray 14*b* that is higher still remains engaged in the engaging groove 20E*a* of the upper surface of the tray 14*a*. Consequently, the rotation of this hook lever 22*b* can form a tray entry portion 17 under the same conditions discussed above between the tray 14*b* that is one level higher and the tray 14*a*.

In this way, an adequate opening can be maintained between the supporting members 20, and even if the stack of recorded sheets fed from the tray entry portion 17 to this tray 14 grows in thickness there will be no jamming like that on conventional devices between the trays 14 at their front edges 14B.

Figure 1:
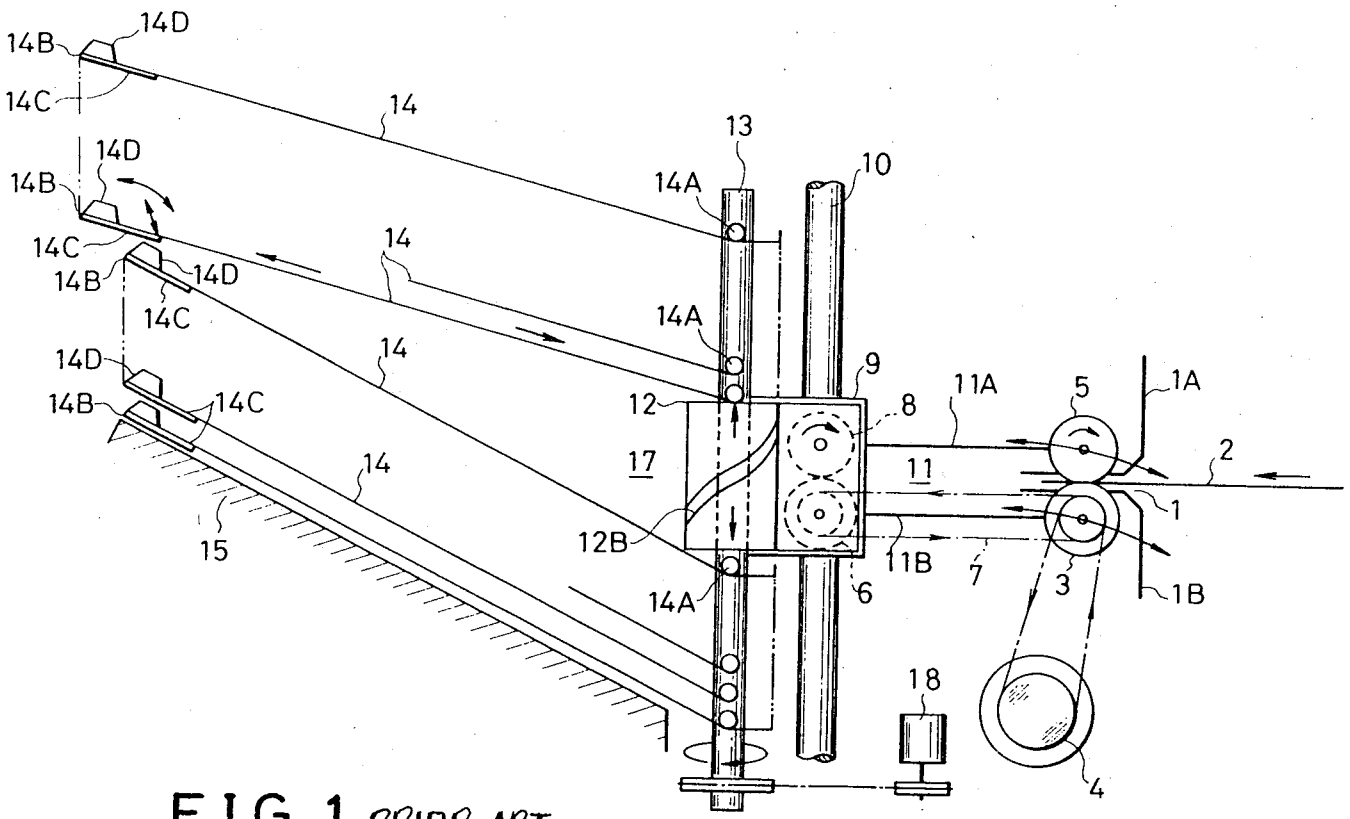
FIG. 1 PRIOR ART
FIG. 1 is a schematic view showing a conventional sorting machine and its trays in a stacked condition.

Furthermore, when the lower tray 14*c* beneath the tray entry portion 17 is moved one level higher from the condition shown in FIG. 2, the movement of that tray 14*c* in a direction of an arrow 40 causes substantially the same conditions as those described above, that is, the hook lever 22*c* of the tray 14*c* which moves at the same time as the hook lever 22*a* that is engaged to the supporting member engaging groove 22E*c* of the tray 14*c* folds into the lever housing portion 20K rises up while it is still engaged to the engaging groove 20E*d* one further level lower so that a tray entry portion 17 can be formed in the same condition as shown in FIG. 1 on one level lower.

In this manner, not only it is possible to maintain a sufficient interval between the area in the vicinity of the front edges of the upper and lower trays forming the tray entry portion and thereby to increase the storage capacity of the individual trays, but also the concern of jamming caused by tapering in the vicinity of the above-mentioned front edges when storing sheets is eliminated, and colliding or sliding motions are not generated between the tray supporting members when the trays move as in conventional apparatuses so that shock noises are not generated and friction forces are reduced. Furthermore, in cases when jamming occurs in the vicinity of the tray entry portion, there is no hindrance to lifting or returning the upper tray in order to remove the jammed sheets and such actions can be performed easily.

It would be understood that power consumption of a motor driving the tray entry forming member is reduced, since the movement of the supporting lever is performed by utilizing the principle of a lever without friction forces.

Moreover, this arrangement involves only a simple engaging groove and attachment of a hook lever, so that it can be carried out without involving high costs.

Further, the form of the hook lever 22 is not limited to the U-shaped spring material shown in the present embodiment, but can also be formed of course from a leaf spring or similar.

Figure 4:
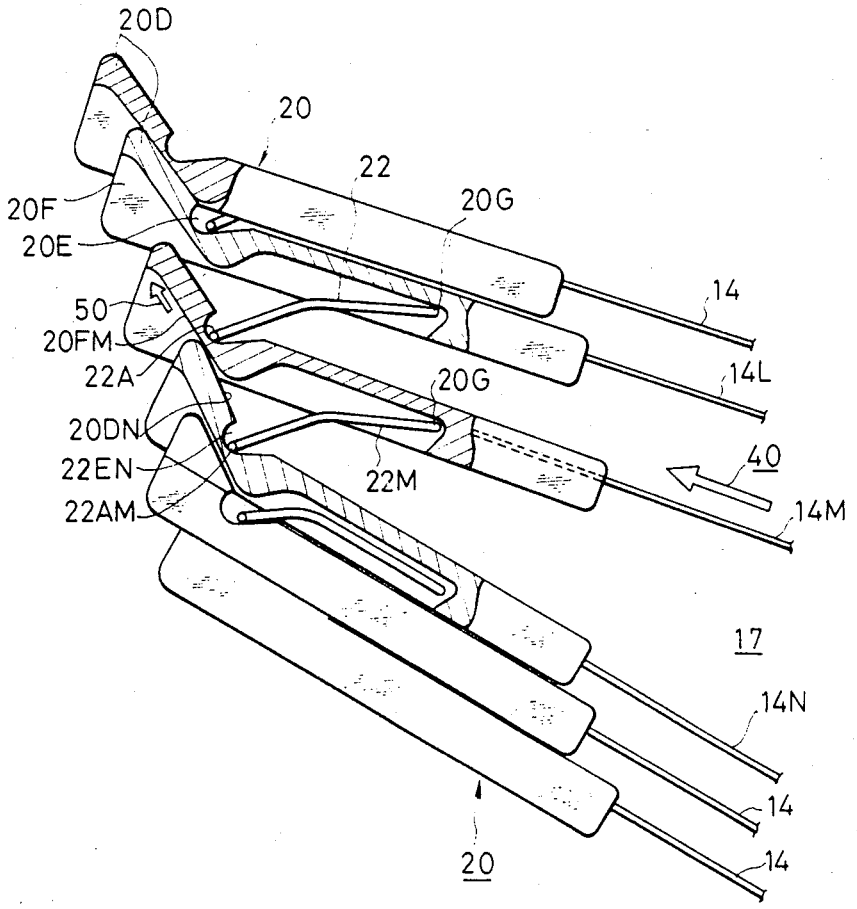
FIG. 4 is a partially exploded perspective view showing an arrangement in the vicinity of a front edge of a tray in a second embodiment of a sorting machine according to the present invention.

An explanation will be made of a second embodiment of the present invention with regard to FIG. 4. In this second embodiment, an upper inclined surface of a protrusion 20D disposed on an upper surface of a front edge of a supporting member 20 is contacted in advance with a bottom surface of an inclined groove 20F disposed on a lower surface of a front edge of the supporting member 20 when the trays are in a stacked condition so that when the trays are first pushed up this upper inclined surface and this bottom surface slide against each other, facilitating the rising up of the hook lever 22. This arrangement is achieved by appropriately determining the length of the hook lever 22, the position of the engaging groove 20E and the relationship between the positions of the upper inclined surface of the protrusion 20D and the bottom surface of the inclined groove 20F.

An explanation will now be made with reference to FIG. 4 of a motion in which the tray 14M is pushed up in a direction of an arrow 40 and the tray entry portion 17 is formed between the tray 14M and the lower tray 14N as an example.

In the initial stages of the pushing up motion, when the tray 14M moves in the direction of the arrow 40, the upper inclined surface of the protrusion 20DN on the supporting member of the tray 14N and the bottom surface of the inclined groove 20FM on the supporting member 20 of the tray 14M engage so that the front of the tray 14M is guided along the upper inclined surface of the protrusion 20DN and pushed up in a direction of an arrow 50. Following this condition, the front portion 22AM of the hook lever 22M engages with the engaging groove 20EN so that this front portion 22AM becomes a pivot and lifts the front of the tray 14M upwardly in the same manner as described in the first embodiment of the present invention.

That is, this initial pushing up movement increases the rotational moment acting on the hook lever 22, thereby facilitating the rising up so as to produce an effect of assisting the rotation of the hook lever during the initial stages of the tray's movement. Next, the hook lever is moved in an arc motion centered on the pivot so that at the front edge of the tray corresponding to the newly formed tray entry portion, the arc movement of the hook lever on the supporting member positioned on top of that tray front edge maintains the interval between the tray front edges, and allows the opening to be maintained.

As well as contributing to the initial movement as described above, the engagement between the protrusion 20D and the inclined groove 20F helps maintain the stability between the trays.

What is claimed is:

1. A tray assembly for a sorting machine comprising:

a plurality of trays;

a pair of tray pins disposed on both edges of each of said plurality of trays on a sheet entry side of each tray;

a supporting member disposed on a front edge of each of said plurality of trays opposite to said sheet entry side for forming a gap between each two of said plurality of trays when said plurality of trays are in a stacked condition;

entry forming means, engaged with said tray pins, for forming successively a sheet entry between two of said trays and causing relative movement of one of said plurality of trays; and means for forming a gap between two of said supporting members in response to longitudinal movement of one of said plurality of trays caused by said entry forming means, said gap forming means being engaging means disposed on an upper surface of said supporting member and a supporting lever pivoted rotatably on said supporting member and whose front portion engages with said engaging means.

2. A tray assembly for sorting machine as claimed in claim 1, wherein said engaging means is a groove disposed in a direction perpendicular to the longitudinal movement direction of the tray.

3. A tray assembly for sorting machine as claimed in claim 1, wherein said supporting lever is formed into a substantially U-shape and whose open edge is pivoted on said supporting member.

4. A tray assembly for sorting machine as claimed in claim 1, further comprising: guide means for pushing up or down one of said plurality of trays in response to longitudinal movement of this tray caused by the entry forming means.

5. A tray for sorting machine as claimed in claim 4, wherein said guide means is formed from an inclined surface on a protrusion disposed on a front of said supporting member and a bottom surface of an inclined groove having a shape corresponding to said protrusion.

6. A tray assembly for sorting machine as claimed in claim 5, wherein said engaging means is a groove disposed in a direction perpendicular to the longitudinal movement direction of the tray.

7. A tray for sorting machine as claimed in claim 5, wherein said supporting lever is formed into a substantially U-shape and whose open edge is pivoted on said supporting member.

8. A tray assembly for sorting machine as claimed in claim 5, wherein in a stacked condition of the trays, except for the trays forming said sheet entry therebetween, an upper inclined surface of said protrusion and a bottom surface of an inclined groove are always in contact and a front of said supporting lever is disposed in a position slightly separated from an engaging means.

9. A tray assembly for a sorting machine having a plurality of trays, a pair of tray pins on both sides of each of said plurality of trays on a sheet entry side of each tray and supporting members each for supporting trays stacked above the tray associated with each supporting member at both edges of a front portion of each tray opposite said sheet entry side so that a tray entry for sheets is formed, each being placed on the upper and lower side of a tray entry forming member which is movable and rotatable about the vertical axis of said tray entry forming member, said tray entry forming member being driven to move one or the other of said plurality of trays upwardly or downwardly so that said tray entry between two of said plurality of trays is shifted accordingly, said tray assembly comprising:

an engaging groove disposed on an upper surface of the individual supporting members;

a hook lever pivoted rotatably in a hole of each of said supporting members, a front edge of said hook lever being engagable in said engaging groove of said supporting member below contacting respectively a lower surface of said supporting member above in a stacked condition; and means for forming a gap when one of said trays is moved by said tray entry forming member through said tray pins and the hook lever disposed on one of said supporting members and the hook lever on another supporting member on a side positioned either above or below of said one of said supporting members are rotated in response to the movement of said tray, said gap being formed between said one of said supporting members moved by a rotation of said hook levers and said another supporting member on a side positioned either above or below of said one of said supporting members.

10. A tray assembly for sorting machine as claimed in claim 9, wherein said supporting members comprise a flat inclined plate inclined upwardly at their respective front portion, and means for assisting an initial rotation of said hook lever when said tray is moved by said tray entry forming member through said tray pins so that said inclined plate slides along an inclined plate of either an upper or a lower supporting member in response to said tray movement.

* * * * *